US005099767A

United States Patent [19]

Günter et al.

[11] Patent Number: 5,099,767

[45] Date of Patent: Mar. 31, 1992

[54] CONNECTION OF TWO-MULTI-AXLE RUNNING GEARS INTO A RUNNING GEAR GROUP FOR RAIL VEHICLES

[75] Inventors: Ahlborn Günter, Siegen; Herbert Büdenbender, Netphen; Eberhard Fiedler; Alfred Lohmann, both of Siegen, all of Fed. Rep. of Germany

[73] Assignee: Waggon Union GmbH, Siegen, Fed. Rep. of Germany

[21] Appl. No.: 443,715

[22] Filed: Nov. 29, 1989

[51] Int. Cl.[5] ..... B61F 5/26

[52] U.S. Cl. ..... 105/453; 105/158.2; 105/176; 105/199.1

[58] Field of Search ..... 105/3, 4.1, 4.2, 158.2, 105/165, 166, 167, 453, 176, 199.1, 199.5, 199.3, 204, 206.1

[56] References Cited

U.S. PATENT DOCUMENTS

| | | | |
|---|---|---|---|
| 194,315 | 8/1877 | Winkle | 105/453 |
| 731,626 | 6/1903 | Sheffield et al. | 105/199.1 |
| 1,493,682 | 5/1924 | Kruger | 105/165 |
| 3,273,516 | 9/1966 | Trumper et al. | 105/454 |
| 3,908,559 | 9/1975' | Fromm | 105/453 |
| 4,221,171 | 9/1980 | Flaig et al. | 105/176 |
| 4,580,686 | 4/1986 | Elliott | 105/3 |

FOREIGN PATENT DOCUMENTS

| | | | |
|---|---|---|---|
| 0885246 | 11/1952 | Fed. Rep. of Germany | 105/182 |
| 1248088 | 7/1960 | Fed. Rep. of Germany | 105/176 |
| 0239836 | 4/1965 | Fed. Rep. of Germany | 105/453 |
| 2317562 | 10/1974 | Fed. Rep. of Germany | 105/453 |
| 2302550 | 2/1978 | Fed. Rep. of Germany . | |
| 2200630 | 1/1980 | Fed. Rep. of Germany | 105/199.3 |
| 3047676A1 | 7/1982 | Fed. Rep. of Germany . | |
| 2346194 | 10/1977 | France | 105/176 |
| 1472325 | 4/1989 | U.S.S.R. | 105/167 |
| 199 | of 1880 | United Kingdom | 105/165 |
| 303796 | 10/1929 | United Kingdom | 105/167 |
| 848884 | 9/1960 | United Kingdom | 105/453 |

*Primary Examiner*—Matthew C. Graham
*Assistant Examiner*—Mark T. Le
*Attorney, Agent, or Firm*—McGlew & Tuttle

[57] ABSTRACT

The present invention pertains to the connection of two multi-axle running gears into a running gear group for rail vehicles with low-lying platform, wherein the running gears have at least two wheel sets with small wheel base and a running gear frame consisting of side walls and crossbeams betweenn two axles. The wheel sets are mounted in the running gear frame via axle bearings, and each running gear is connected to the platform with false pivot only via a leaf spring and link suspension located transversely in front of and along each side wall. To ensure that the correct turn-out angle of each running gear and each running gear group is freely guaranteed during cornering, and at a correct axle load equalization of the running gears of each running gear group is ensured. The running gears of each running gear group are connected via a connecting beam that is arranged in the middle of the length of the running gears and is hinged on same, wherein the connecting beam is guided centrally with a clearance between guide brackets of the platform. The ends of each leaf spring of the running gears of each running gear group, which ends face each other, are connected to one another via their links by an equalizing lever, which is mounted on a bracket of the car bridge.

6 Claims, 3 Drawing Sheets

CONNECTION OF TWO-MULTI-AXLE RUNNING GEARS INTO A RUNNING GEAR GROUP FOR RAIL VEHICLES

FIELD OF THE INVENTION

The present invention pertains to the connection of two multi-axle running gears into a running gear group for rail vehicles with low-lying platform, wherein the running gears have at least two wheel sets with small wheel base and a running gear frame consisting of side walls and a crossbeam between two axles; the wheel sets are mounted in the running gear frame via axle bearings, and each running gear is connected to the platform with false pivot only via one leaf spring each, located lengthwise transversely in front of each side wall and one link suspension each.

BACKGROUND OF THE INVENTION

Two-axle running gears of the class specified in the introduction are known from West German Patent Specification No. 23,02,550, in which the running gear frame carries, at each of the two transverse ends in the middle of its length, one vertical open horn plate guide designed as a rectangle on the inside, with a straight and flat horn plate fastened to the vehicle body reaching into said horn plate guide from the top. In this prior-art design of a two-axle running gear, said running gear is guided on the vehicle in the same way as a single axle. The axial and transverse clearances, as well as the horizontal deflection of the running gear are limited by the clearance in the horn plate guide. The running pattern of a single axle is approached as closely as possible due to the small wheel base that is thus made possible. The absence of a swivel ring or a live ring makes it possible to attain a very low overall height. To obtain this low overall height, the support for the leaf springs is placed transversely to the running gear in front of the axle bearings.

The running gear is connected to the platform only via one leaf spring each mounted on the outside in front of and along the side wall.

One disadvantage of this prior-art design for the combination of a plurality of running gears into a running gear group for vehicles with high payload is the direct guiding of each running gear on the vehicle frame or the platform. The necessary turn-out angle of the individual running gears during cornering can no longer be absorbed by the transverse clearance in the running gear guide. Another disadvantage is the fact that the height of displacement of the individual running gears on uneven tracks or during travel on slopes leads to great irregularities in the axle loads.

SUMMARY AND OBJECTS OF THE INVENTION

It is an object of the present invention to integrate running gears of the class specified in the introduction into running gear groups and to guide them under the vehicle frame or the platform so that the turn-out angle of each running gear and each running gear group during cornering can become established freely; to guarantee accurate equalization of the axle loads of the running gears of each running gear group; and to ensure the connecting members required for the individual running gears do not adversely affect the overall height.

This task is achieved according to the present invention by connecting the running gears of each running gear group by a connecting beam arranged in the middle of the length of the running gears and hinged to same, wherein said connecting beam is guided between guide brackets of the platform with a clearance. The ends of each leaf spring of the running gears, which ends face each other, are connected to one another via their links by an equalizing, which is mounted on a bracket of the car bridge. It is ensured by the present invention that the overall height of the running gear group is not greater than that of a single running gear. It is also ensured that the ideal fulcrum point is exactly defined when transverse clearance is utilized, even in the case of asymmetric running gears. The amount of the transverse clearance in the running gear group is consequently also defined exactly. The axle load equalization between the running gears of each running gear group is guaranteed.

In the embodiment of the present invention, each connecting beam on each running gear is crowned and is mounted with a clearance. This causes the running gears to be freely supported by the connecting beam during travel on slopes. The connecting beam is also mounted with longitudinal and transverse clearances in the guide brackets of the car bridge. It is thus possible to accurately predetermine the required longitudinal and transverse clearances to achieve good riding qualities.

The transverse stops in the guide brackets are crowned on the inside. This measure ensures accurate transverse clearances even during cornering.

Elastic stops are inserted between the guide brackets and the connecting beam in the transverse direction of the running gear. These elastic stops also improve the riding qualities of the vehicle.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
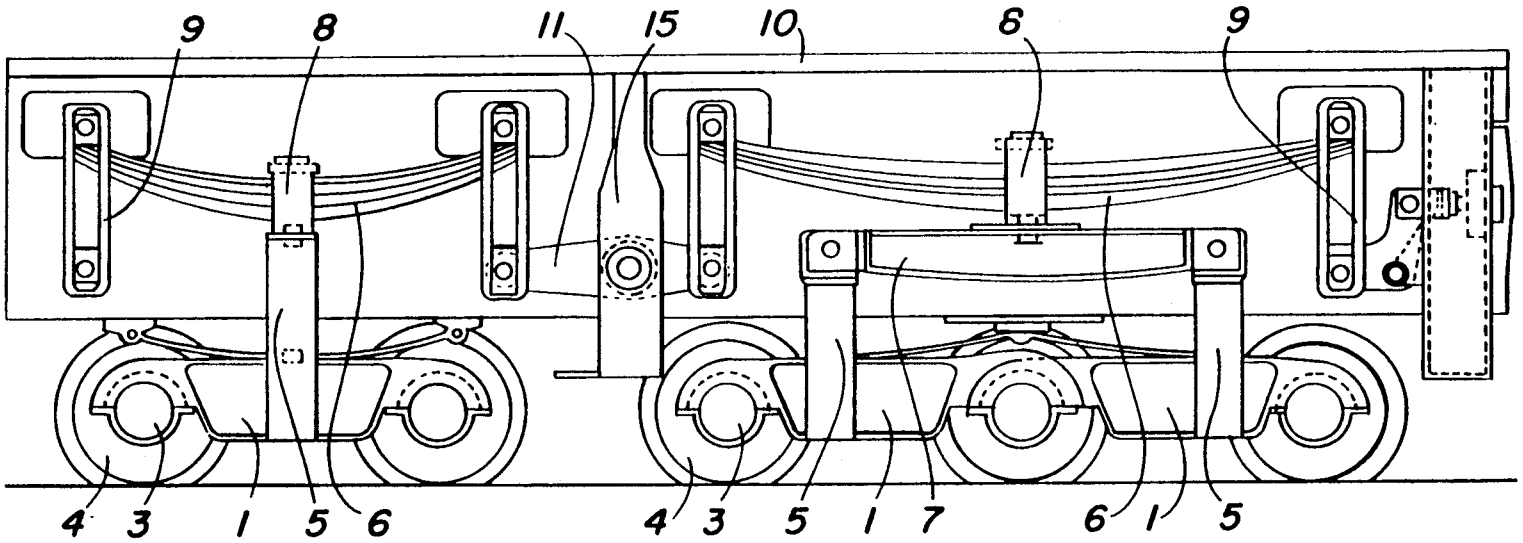
FIG. 1 is a side view of a running gear group according to the present invention, consisting of a two-axle running gear and a three-axle running gear.

As is shown in the drawings, each running gear of each running gear group consists essentially of the running gear frame formed by the side walls 1 and crossbeam 2, the wheel sets 4 being mounted in the side walls 1 via axle bearings 3. The side walls 1 are provided on the outside with spring brackets 5, on which a longitudinal leaf spring 6 is mounted directly in the case of a two-axle running gear and via a traverse 7 with its spring shackle 8, which traverse 7 is hinged on the spring brackets 5, in the case of a three-axle running gear. Each leaf spring 6 is directly connected via its outer link 9 to the platform 10 or the vehicle frame. The inner ends of each leaf spring 6 which face each other are connected to the platform 10 or the vehicle frame via an equalizing lever 11 hinged vertically in a bracket 15 of said platform 10 or in the vehicle frame. A connecting beam 13, which connects the two running gears of each running gear group to each other in an articulated manner, is mounted with its longitudinal ends in spherical bearings 12 on crossbeams 2 of the running gear frame in the middle of the length of the running gear. The joints 12 are designed with a defined longitudinal clearance. In the middle of the transverse extension, the connecting beam 13 is guided on guide brackets 14 pointing vertically downward, which are arranged on said platform 10 or the vehicle frame and have longitudinal and transverse clearances, so that the running gear group is provided with exact longitudinal and transverse clearances relative to the platform or the vehicle frame. The guide brackets 14 are crowned on their inside. Elastic stops 15 can be inserted between the connecting beam 13 and the guide brackets 14 in the transverse direction.

Figure 2:
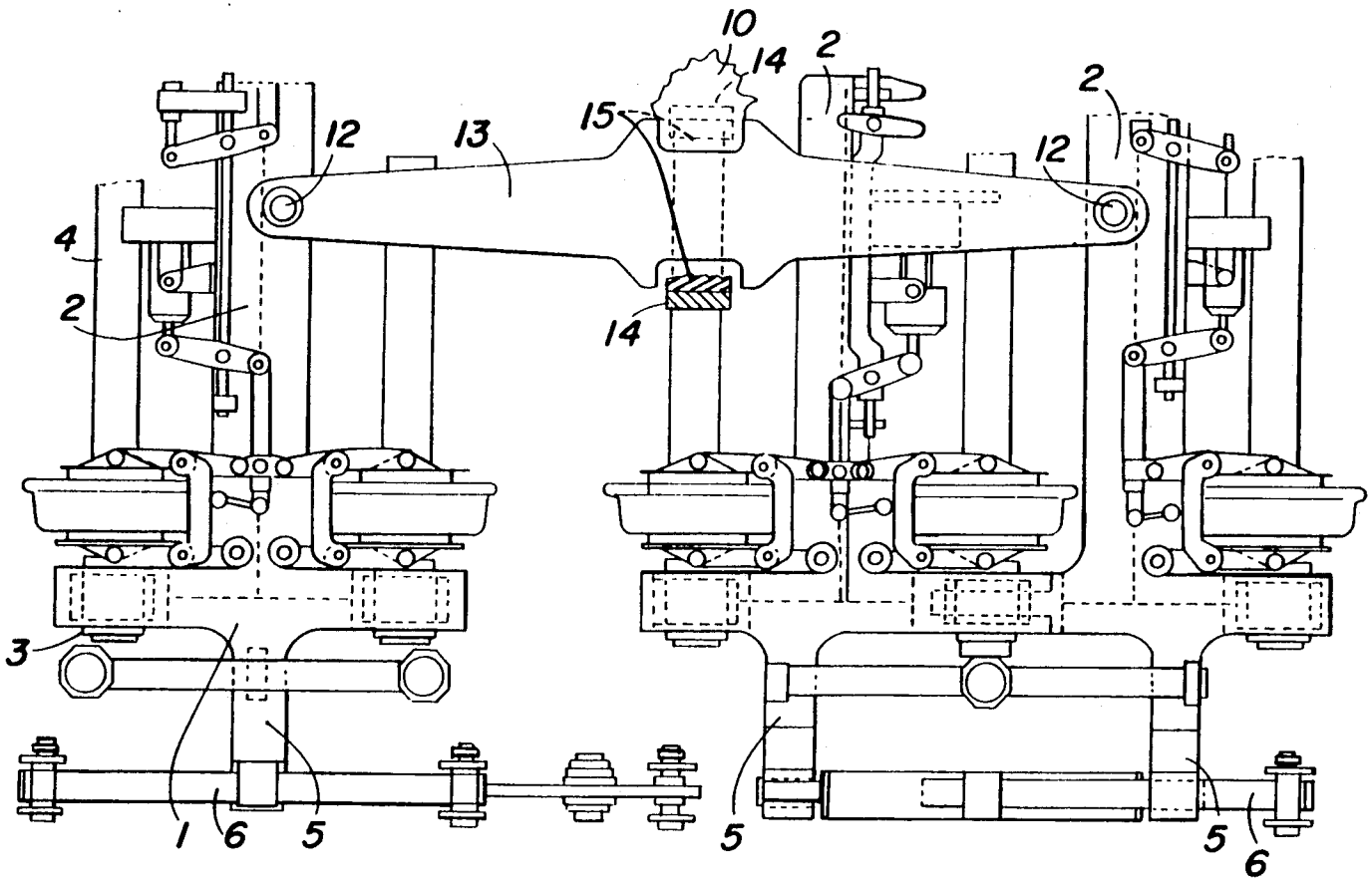
FIG. 2 is a the top view of the running gear group according to FIG. 1; and, FIG. 3 is a top view of a running gear group according to the present invention, consisting of two two-axle running gears.
Figure 3:
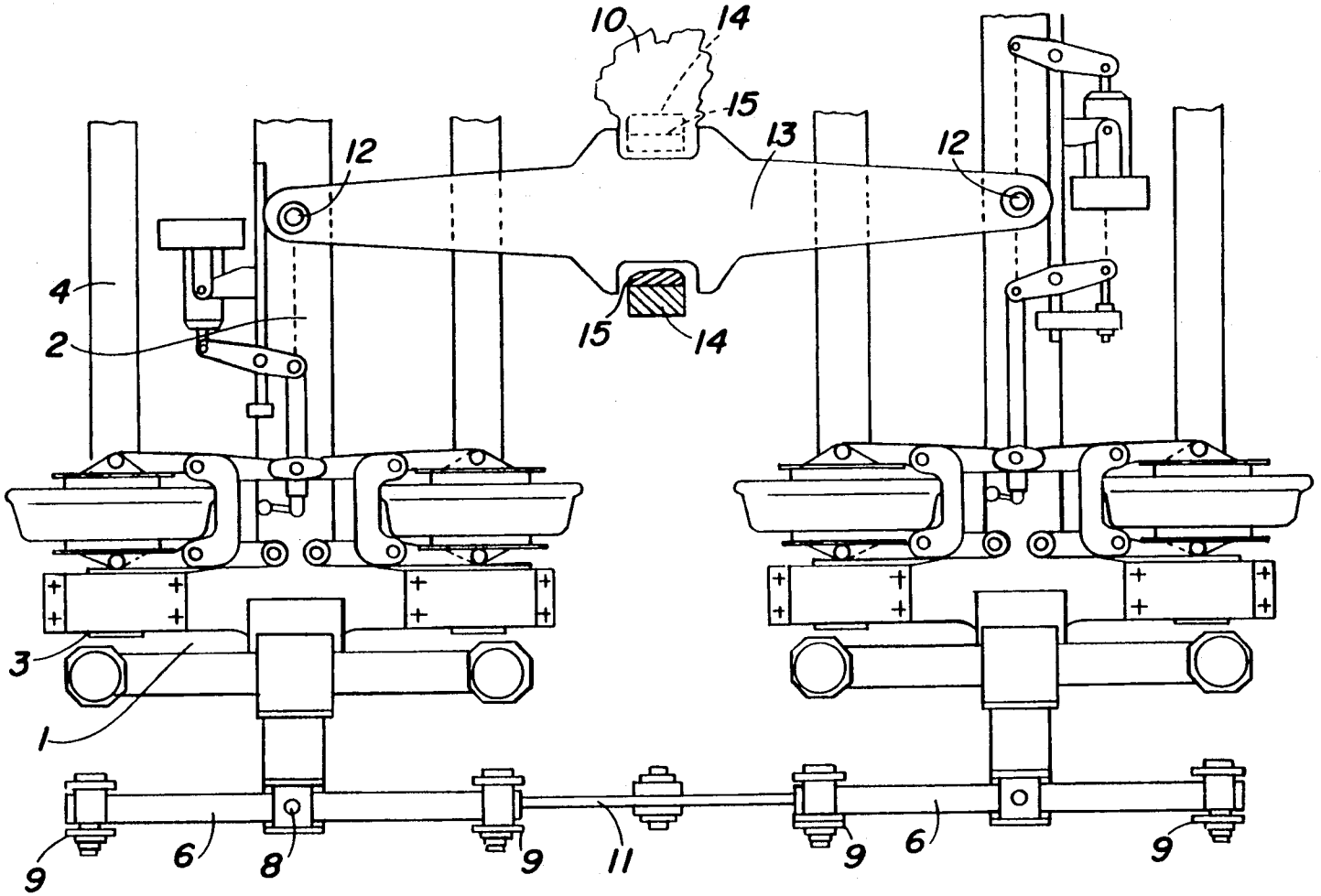

The running gear group shown in FIG. 3 consists of two two-axle running gears. Each running gear consists, in turn, at least of the side walls 1, a crossbeam 2 connecting same, and the wheel sets 4 mounted in the side walls 1 via the axle bearings 3. A spring bracket 5, on which the leaf spring 6 is mounted via the spring shackle 8, is arranged on each side wall 1 on the outside. Each outer end of each leaf spring 6 is mounted directly on the platform via a link pair 9. The ends of each leaf spring 6 facing each other are supported, via a link pair 9 each, on an equalizing lever 11 hinged on the platform. The running gears of the running gear group are hinged to one another by a connecting beam 13 via ball joints 12 arranged on the crossbeam 2 of the running gear frame. Just as in the above-described embodiment, the connecting beam 13 is guided in guide brackets 14 pointing vertically downward, which are arranged on said platform and have longitudinal and transverse clearances. The arrangement and the design of the guide brackets 14 in the embodiment are the same as in the embodiment described in FIGS. 1 and 2.

While specific embodiments of the invention have been shown and described in detail to illustrate the application of the principles of the invention, it will be understood that the invention may be embodied otherwise without departing from such principles.

What is claimed is:

1. A running gear group connection arrangement for rail vehicles with low-lying platforms, comprising: first and second running gear assemblies, each running gear assembly having at least two wheel sets with a small wheel base and a running gear frame including side walls and a cross beam between axles, associated with each wheel set, each wheel set being mounted to the running gear frame via axle bearings; first and second leaf springs, each leaf spring being connected to the platform via link suspension elements; first and second spring bracket means for connecting first and second running gear assemblies to corresponding first and second leaf springs; a connecting beam connecting said first and second running gear assemblies, said connecting beam being hinged to each running gear assembly; and, guide brackets connected to said platform for guiding said connecting beam with a clearance.

2. A running gear group connection arrangement according to claim 1, wherein ends of each leaf spring, facing each other, are connected one to the other via said link suspension elements by an equalizing lever, said equalizing lever being mounted on a bracket connected to said platform.

3. A running gear group connection arrangement according to claim 1, further comprising a ball joint arrangement mounting said connecting beam to a running gear assembly.

4. A running gear group connection arrangement according to claim 1, wherein said guide brackets include longitudinal and transverse clearances for guiding said connecting beam.

5. A running gear group connection arrangement according to claim 1, wherein said guide brackets include transverse stops are of crowned shape on an inside surface.

6. A running gear group connection according to claim 1, wherein elastic stops are provided inserted between said guide brackets and said connecting beam in a transverse direction of the running gear assemblies.

* * * * *